United States Patent [19]

Rassieur

[11] Patent Number: 4,870,738

[45] Date of Patent: Oct. 3, 1989

[54] VEHICLE MOUNTED DRILL ROD HOLDING DEVICE

[75] Inventor: Charles L. Rassieur, St. Louis County, Mo.

[73] Assignee: Central Mine Equipment Company, St. Louis, Mo.

[21] Appl. No.: 204,573

[22] Filed: Jun. 9, 1988

[51] Int. Cl.[4] ..... B25B 13/50

[52] U.S. Cl. ..... 29/240

[58] Field of Search ..... 29/240; 81/57.33, 57.34, 81/57.35, 57.4, 57.41, 57.16, 57.24, 57.25; 254/132, 30, 134.3 R, 134.3 FT; 269/25, 71, 45; 901/27, 28

[56] References Cited

U.S. PATENT DOCUMENTS

| | | | |
|---|---|---|---|
| 3,844,547 | 10/1974 | Lang et al. | 269/25 |
| 3,871,427 | 3/1975 | Widegren et al. | 254/132 |
| 4,076,131 | 2/1978 | Dahlstrom et al. | 901/27 |
| 4,345,493 | 8/1982 | Rassieur | 81/57.34 |

*Primary Examiner*—Robert C. Watson

*Attorney, Agent, or Firm*—Polster, Polster, and Lucchesi

[57] ABSTRACT

A vehicle mounted drill rod holding device wherein a longitudinally extending clamp support having clamping means thereon is mounted at one end of a vehicle to be capable of extending in cantilever fashion from the vehicle at an angle to the line or direction of movement of the vehicle including means to allow rotation of the clamp support about its longitudinal axis and actuating linkage means to permit adjustable rotation to ensure flush positive engagement of the clamping means with the drill rod.

9 Claims, 1 Drawing Sheet

VEHICLE MOUNTED DRILL ROD HOLDING DEVICE

BACKGROUND OF THE INVENTION

The present invention relates to an improved vehicle mounted device for holding, unthreading and disconnecting drill rods and drill rod sections.

As set forth in U.S. Pat. No. 4,345,493, issued to Charles L. Rassieur on Aug. 14, 1982, it is known to insert connected five and ten-foot drill string sections of a drill rod into a hole several hundred feet deep or more and to disconnect these connected drill rods in ten or twenty foot lengths when withdrawn from the hole with the aid of a rod holding device mounted on a suitable vehicle frame. The rod holding device is provided with clamping jaw means removed from the rod during drilling and which, when not drilling, serves to grip the rod to prevent the rod from moving axially and to inhibit the rod from turning.

In the aforementioned patent, unique structure is provided which allows for ready adjustment to accommodate for misalignment of the vehicle relative the drill string to be held by opposed gripping clamps driven by two hydraulic cylinders. The opposed clamps and hydraulic cylinders are carried on a support which is pivotally mounted on a vehicle. The support further includes a power actuated break-out device for breaking a drill string joint gripped by the clamps.

The present invention not only recognizes the many advantages of this previously disclosed unique structure but further recognizes the importance of employing flush, positive engagement of the jaw means with the drill rod section to allow the drill rod section to be held firmly by the jaws regardless of the incline of the surface on which the vehicle supporting this structure rests. Although it is generally known, as disclosed in U.S. Pat. No. 3,844,547, issued to D. M. Lang et al on Oct. 29, 1974, to individually rotate opposed jaw holding members with rotatable structure located immediately adjacent the opposed jaw members to ensure positive engagement of the jaw members with a pipe section during drill string coupling and uncoupling procedures, and although it is generally known to pivot a structural member about two .axes perpendicular to each other, as disclosed in U.S. Pat. No. 4,725,068, issued to C. D. Taylor et al on Feb. 16, 1985, the present invention recognizes the desirability of ensuring positive engagement of jaw means such as in the unique drill rod holding structure as disclosed in aforementioned U.S. Pat. No. 4,345,493. Further, the present invention recognizes the desirability of rotatably adjusting jaw means simultaneously from a position remote from the jaw means and ideally from a position proximate to the vehicle from which a jaw means support member is cantilevered.

Various other features of the present invention will become obvious to one skilled in the art upon reading the disclosure set forth herein.

SUMMARY OF THE INVENTION

More particularly, the present invention provides in a vehicle mounted drill rod holding device, a longitudinally extending clamp support mounted at one end to a vehicle to be capable of extending in cantilever fashion therefrom at an angle to the line of movement of the vehicle, the cantilevered support including clamping means thereon to clamp and firmly hold a drill rod; means to allow rotation of the clamp support about its longitudinal axis to accommodate for departure from a horizontal plane of the longitudinal axis of the vehicle when the vehicle is positioned on a hill with the clamp support extending at an angle to the vehicle line or direction of movement; and, actuating means connected to the clamp support to permit adjustable rotation of the clamp support about its longitudinal axis in a controlled manner to ensure flush, positive, firm engagement of the gripping face of the clamping means with the outer surface of a drill rod section. The clamp is rotatable about its longitudinal axis so that it can be positioned horizontally with respect to a plumb line so that it can easily swing on its axis and not be affected by gravity. In addition, the present invention provides, in combination with the foregoing structure, a means for sliding the clamp support in an in and out direction in a lineal manner relative the longitudinal axis of the clamp support, and a means to pivotally swing the clamp support toward and away from the vehicle from which is is supported.

It is to be understood that various changes can be made by one skilled in the art in the several parts of the apparatus disclosed herein without departing from the scope or spirit of the present invention. For example, it would be possible to utilize other clamping means than the disclosed opposed jaw arrangement and other actuating means than the turn-buckle assembly disclosed.

BRIEF DESCRIPTION OF THE DRAWING

Referring to the drawing which discloses one advantageous embodiment of the present invention.

DESCRIPTION OF THE PREFERRED EMBODIMENT

Figure 1:
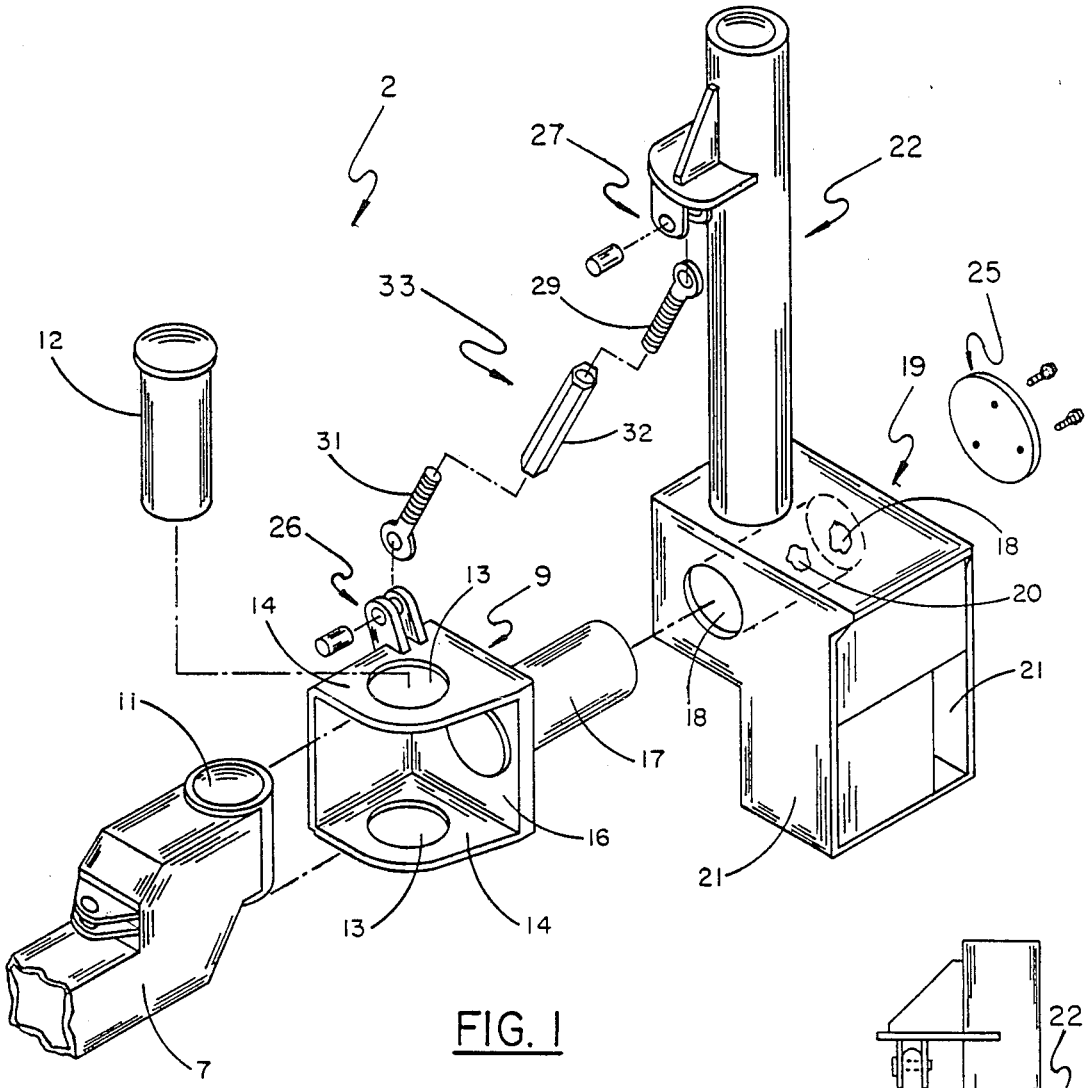
FIG. 1 is an exploded isometric view of a portion of the novel structure of the present invention.

In a manner similar to that discussed and disclosed in above U.S. Pat. No. 4,345,493, the drill rod holding and break-out device 2 of FIGS. 1 and 2 of the drawing can be mounted on any one of several suitable field vehicles as is disclosed in FIG. 1 of U.S. Pat. No. 4,345,493, the vehicle on which it is mounted also being capable of carrying an appropriate rotary drilling rig, for example, of the type described in U.S. Pat. No. 3,527,309. Also as disclosed in previous U.S. Pat. No. 4,345,493, the novel structure of FIGS. 1 and 2 described herein can be employed with a drill string with an upper rod section as shown in FIG. 1 of U.S. Pat. No. 4,345,493 as clamped preparatory to breaking a joint.

Figure 2:
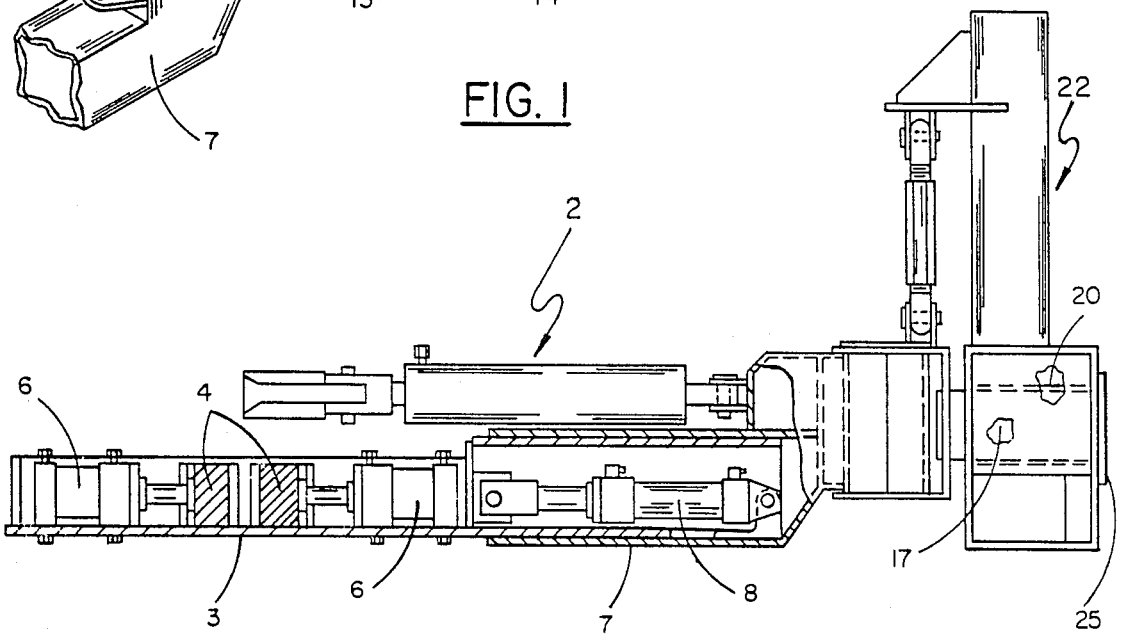
FIG. 2 is a view in front elevation, partly broken away and partly in section similar to the view in FIG. 4 of aforementioned U.S. Pat. No. 4,345,493 but incorporating the novel structure isometrically disclosed in FIG. 1.

The vehicle mountable drill rod holding device 2, as can be seen more fully in FIG. 2 of the drawing, includes a longitudinally extending clamp support 3 having oppositely disposed drill rod clamp jaws 4 mounted thereon which can be adjustably moved toward and away from each other by hydraulic cylinders 6 mounted on clamp support 3 and respectively connected to jaws 4. One end of clamp support 3 is slidably mounted and supported in housing 7. A hydraulic cylinder 8 mounted in housing 7 is connected to the end of clamp support 3 to allow the clamp support to be slidably moved lineally in an in and out direction relative housing 7.

As can be seen more readily in FIG. 1 of the drawing, housing 7 has one end thereof pivotally mounted in a cradle-like member 9, the end of housing 7 being provided with a sleeve 11 which pivots about pin 12 extending through opposed apertures 13 in the opposite side walls 14 of cradle 9, to which pin 12 is fixed. Through pin 12 in cradle 9 it is possible to swing housing 7 and thus clamp support 3 toward and away from a vehicle on which the apparatus can be mounted.

The back wall of cradle 9, which extends between corresponding ends of opposed side walls 14 of cradle 9, in turn, is mounted on one end of pin 17 which pin 17 extends through a bushing 20 welded to aligned apertures 18 in the opposite side walls or plates 21 of housing 19 to be rotatably supported in housing 19 to allow cradle member 9 to be pivoted about an axis parallel to the longitudinal axis of clamp support 3 and housing 7. The end of pin 17 is drilled and tapped and plate 25 is bolted to the end of pin 17 so that pin 17 is retained in housing 19.

In accordance with the present invention, to pivot cradle 9 and thus housing 7 and clamp support 3 about their longitudinal axes, a pin and clevis assembly 26 is fixed to one side wall 14 of cradle 9. A similar pin and clevis assembly 27 can be fixed to the upper extremity of post 22, which post also can serve as a hydraulic jack housing. The pins of pin and clevis assemblies 26 and 27 serve to moor the eyes of oppositely threaded eye bolt members 29 and 31 which engage in internally threaded sleeve 32 of turn-buckle assembly 33. Thus, by merely selectively turning or rotating sleeve 32 with a suitable wrench, advantageously, from a position accessible from the vehicle on which post 22 is mounted, the extending or contracting actuating linkage in the form of such turn-buckle assembly 33 provides rotational adjustment of cradle member 9, housing 7 and clamp support 3 about their respective longitudinal axes in a controlled manner to ensure flush, positive and firm engagement of the gripping faces of opposed clamp jaws 4 with the outer surface of a drill rod compensating for conditions when the vehicle on which post 22 is mounted is stopped at an incline to the drill string to be held and broken and the clamp support is at an angle to the vehicle line of movement. Accordingly, it not only is possible to now move drill holding and breaking apparatus in and out toward and away from a drill string and to swing or pivot such apparatus toward and away from such drill string, but it also now is possible to accomplish these movements and also rotate the drill holding and breaking apparatus about the longitudinal support axis so that the apparatus will swing perpendicular to a plumb line to reduce the effort to swing the apparatus and to avoid opposed jaw binding which might otherwise occur if the vehicle is at rest on an incline and the clamp support extends at an angle to the normal line of travel of the vehicle.

The invention claimed is:

1. In a vehicle mounted drill rod holding device, a longitudinally extending clamp support mounted at one end to said vehicle to be capable of extending in longitudinal cantilever fashion therefrom at an angle to the line of movement of said vehicle, said support including clamping means thereon to clamp and firmly hold a drill rod, means to allow rotation of said longitudinally extending cantilevered clamp support coincidentally about its longitudinal axis to accommodate for departure from a horizontal plane of the longitudinal axis of said vehicle when said vehicle is positioned on a hill with said clamp support extending at an angle to the vehicle line of movement;

actuating means connected to said clamp support to ensure flush, positive engagement of the gripping face of said clamping means with the outer surface of a drill rod; and, means to permit adjustable rotation of said clamp support about its longitudinal axis in a controlled manner.

2. The vehicle mounted drill rod holding device of claim 1 including a housing for mounting and supporting one end of said clamp support for sliding in in and out directions with respect to said housing and means mounted in said housing and connected to said clamp support for moving said clamp support in said in and out directions.

3. The vehicle mounted drill rod holding device of claim 1 and means mounted on said vehicle for pivotally swinging said clamp support toward and away from said vehicle.

4. The vehicle mounted drill rod holding device of claim 1, said means to allow rotation of said clamp support about its longitudinal axis being positioned on said vehicle adjacent said mounted end of said support.

5. The vehicle mounted drill rod holding device of claim 4, said means to allow rotation of said clamp support about its longitudinal axis including a cradle member sized to receive and retain said end of said clamp support, said cradle member being pivotably mounted on said vehicle about an axis parallel to the longitudinal axis of said clamp support.

6. The vehicle mounted drill rod holding device of claim 5, said end of said clamp support being pivotally retained in said cradle member to pivot about an axis normal to said pivot axis of said cradle member whereby said cantilever mounted clamp support can be pivoted relative said vehicle toward and away therefrom.

7. The vehicle mounted drill rod holding device of claim 6, said actuating means to adjustably rotate said clamp support about its longitudinal axis including a turn-buckle member including a rotatable sleeve having oppositely threaded rods extending from each end with one rod fixed at free end to said vehicle and the other rod fixed at its free end to said cradle member whereby selective rotation of said turn-buckle sleeve provides rotational adjustment of said cradle member about its longitudinal axis.

8. In a vehicle mounted drill rod holding and breakout device including a longitudinally extending clamp support having oppositely disposed drill rod clamp jaws mounted thereon to be moveable toward and away from each other, means to move said support in an in and out direction relative the longitudinal axis of said support, means to mount and pivot said support relative said vehicle toward and away therefrom, means to allow rotation of said clamp support about its longitudinal axis to accommodate for departure from a horizontal plane of the longitudinal axis of said vehicle when positioned on a hill with said clamp support extending at an angle to the vehicle line of movement; and actuating linkage means to permit adjustable rotation of said clamp support about its longitudinal axis in a controlled manner to ensure flush, positive engagement or the gripping face of said clamping means with the outer surface of a drill rod.

9. In a vehicle mounted drill rod holding device including a longitudinally extending clamp support having oppositely disposed drill rod clamp jaws mounted thereon to be moveable toward and away from each other;

a housing for mounting and supporting one end of said clamp support for sliding in in and out directions with respect to said housing;

means mounted in said housing and connected to said clamp support for moving said clamp support is said in and out directions with respect to said housing;

means mounted on said vehicle for pivotally supporting said housing for swinging said housing and support toward and away from said vehicle, said means mounted on said vehicle including a cradle member sized to receive and retain an and of said clamp support housing, said cradle member being pivotally mounted on said vehicle about an axis parallel to the longitudinal axis of said clamp support with said end of said clamp support being pivotally retained in said cradle member to pivot about an axis normal to said pivot axis of said cradle member whereby said cantilever mounted clamp support can be pivoted relative said vehicle toward therefrom; and, cradle member actuating linkage including a turnbuckle member having a rotatable sleeve accessible from said vehicle, said sleeve having oppositely threaded rods extending from each end with one rod fixed at its free end to said vehicle and the other rod fixed at its free end to said cradle member whereby selective rotation of said turn-buckle sleeve provides rotational adjustment of said cradle member and said clamp support about their respective longitudinal axes in a controlled manner to ensure flush, positive engagement of the gripping face of said clamping means with the outer surface of said drill rod.

* * * * *